US005570572A

United States Patent [19]

Birkenmaier et al.

[11] Patent Number: 5,570,572

[45] Date of Patent: Nov. 5, 1996

[54] DRIVE AND BEARING FOR A SHAFT-LESS OPEN-END SPINNING ROTOR

[75] Inventors: Wilhelm Birkenmaier, Weinstadt-Beutelsbach; Anton Paweletz, Fellbach-Oeffingen, both of Germany

[73] Assignee: SKF Textilmaschinen-Komponenten GmbH, Stuttgart, Germany

[21] Appl. No.: 295,859

[22] PCT Filed: Feb. 26, 1993

[86] PCT No.: PCT/EP93/00443

§ 371 Date: Sep. 30, 1994

§ 102(e) Date: Sep. 30, 1994

[87] PCT Pub. No.: WO93/18212

PCT Pub. Date: Sep. 16, 1993

[30] Foreign Application Priority Data

Mar. 11, 1992 [DE] Germany ..... 42 07 673.0

[51] Int. Cl.[6] ..... D01H 4/14

[52] U.S. Cl. ..... 57/406; 57/100

[58] Field of Search ..... 57/100, 406, 404, 57/414

[56] References Cited

U.S. PATENT DOCUMENTS

| | | | |
|---|---|---|---|
| 4,022,008 | 5/1977 | Pimiskern et al. | 57/100 |
| 4,306,166 | 12/1981 | Quandt | 57/100 X |
| 4,543,780 | 10/1985 | Müller et al. | 57/100 X |

FOREIGN PATENT DOCUMENTS

| | | | |
|---|---|---|---|
| 0190440 | 8/1986 | European Pat. Off. . | |
| 0302314 | 2/1989 | European Pat. Off. . | |
| 2640111 | 3/1978 | Germany . | |
| 3000357 | 7/1981 | Germany . | |
| 1687660 | 10/1991 | U.S.S.R. | 57/100 |
| WO9201096 | 1/1992 | WIPO . | |

OTHER PUBLICATIONS

Patent Abstracts of Japan —vol. 10, No. 207(M–500)(2263) 19 Jul. 1986 & JP A 61 048 613(Ryuichi Matsuda) 10 Mar. 1986.

*Primary Examiner*—Joseph J. Hail, III
*Attorney, Agent, or Firm*—Shefte, Pinckney & Sawyer

[57] ABSTRACT

A device for an open-end spinning machine is disclosed having a drive and a bearing for a shaft-less spinning rotor that forms the rotor of an axial field motor. The device has a stator with a hollow, cylindrical core, a multiphase winding, and a combined magnetic/gas bearing. The bearing has gas outlet bores in an axial, plane-parallel bearing face providing for gas distribution symmetrically about the axis, and there are holding and centering magnets centered in the bearing face. The housings of the stator and the bearing are combined into a one-piece stator housing in which are formed the device for cooling, the gas distribution device, holders for spring and clamping elements of the stator housing suspension, and a support for a sensor plate. The housing also integrates a yoke plate of the bearing and connections for supply lines. A gas chamber therein is closed off on the open side by a gas bearing cover. The device housing has fitting elements and the spinning rotor is surrounded by a guide ring which forms an annular gap and limits its deflection out of the bearing center.

22 Claims, 3 Drawing Sheets

DRIVE AND BEARING FOR A SHAFT-LESS OPEN-END SPINNING ROTOR

BACKGROUND OF THE INVENTION

The invention relates to a device for an open end spinning machine with a drive and bearing for a shaftless spinning rotor in accordance with the preferred embodiment of the present invention. Such a device with a drive and bearing for a shaftless open end spinning rotor is known from patent application WO 92/01096. Its combined magnetic-gas bearing with plane-parallel bearing faces is distinguished by extremely low friction losses and by a rotation around the axis through the center of gravity which is free of radial forces of the spinning rotor seated thereon in the supercritical rpm range. Such a device is particularly suited for driving very rapidly rotating spinning rotors. The construction of the device is still too expensive. It is also disadvantageous that, because of the many components, numerous joining tolerances can add up and in this way the exact position of the spinning rotor axis in relation to the axis of the take-off nozzle in the spinning machine can be impaired. The tolerance requirements, the costs of manufacturing and installation make the known device expensive. It is not possible in this device to prevent damage to the spinning rotor in case of possible extreme deflections of the spinning rotor.

SUMMARY OF THE INVENTION

It is the object of the invention to remove these disadvantages, to improve the operational dependability and the efficiency. It is also intended to reduce the axial space requirements. The device is intended to be suitable for driving spinning rotors of different sizes.

Briefy summarized, the stator core with its winding is fixedly seated in a one-piece stator housing made, for example, of injection-molded plastic material. The housing for the gas bearing, the gas distribution device, areas for cooling the stator and the bearing as well as holders for the spring and damping elements of the stator suspension are also formed in this stator housing. This one-piece stator housing has the advantage that seating tolerances which occur when several parts are joined together are avoided. It is achieved in this way that the magnetic guide axis coincides with the axis through the center of gravity, because inaccuracies on account of joining tolerances and magnetic tolerances during assembly do not occur.

The yoke plate of the magnetic bearing and connections for the supply lines are integrated into the stator housing. On its open side, the chamber for the pressure gas in the stator housing is sealed by means of a gas bearing cover. The combination of several parts and functions in a common stator housing lowers the manufacturing costs of the device, because several work steps of positionally exact joining and gluing and of curing in-between are omitted. The improvements by means of the novel one-piece stator housing with the parts of the device formed thereon also result in a more dependable device. The guide ring surrounding the inserted spinning rotor in an annular gap limits its possible deflection, so that the spinning rotor cannot leave the field of the holding and centering magnets in the stator housing and instead is guided back into the bearing center.

In accordance with the preferred embodiment of the present invention, a yoke plate injection-molded into the stator housing has a threaded stem for the gas bearing cover, and the gas bearing cover has a gas connector with a threaded bore.

In accordance with the preferred embodiment of the present invention the dimensional stability of the bearing is improved by means of reinforcing ribs in the gas chamber of the stator housing.

In the embodiment in accordance with the preferred embodiment of the present invention, the housing of the device consists of an upper housing part and a lower housing part, and the spring and damping elements for the stator are formed in one piece with the lower housing part.

In accordance with the preferred embodiment of the present invention, the holders of the stator housing are placed on bar springs seated in holders at the free end of plate springs of the lower housing part. A one-piece embodiment of the stator housing and the lower housing part, in which the damped stator suspension is realized by means of elastic connections of both housings, further simplifies the assembly of the device. This embodiment combines a compact structure with the elastic suspension of the stator.

In accordance with the preferred embodiment of the present invention, the width of the annular gap between the guide ring and the inserted spinning rotor is of such a size that bucking of the spinning rotor against the spinning machine, for example when passing through the critical rpm during free-wheeling slow-down, is assuredly prevented.

In accordance with the preferred embodiment of the present invention, the Hall sensors for motor control as well as the temperature sensors for controlling the bearing temperature are positioned and connected on the sensor plate, which is embodied as a printed circuit foil. Both types of sensors are located in the free winding gaps, wherein preferably the temperature sensors are located in different winding gaps than the Hall sensors. The connections of the sensor plate and of the winding are each passed through segment-shaped openings in the stator housing to a contact point.

A particularly effective heat dissipation out of the stator and the gas bearing is achieved by means of a cooling conduit in the area of the winding, through which a coolant flows.

In a particularly simple embodiment, window-like openings in the stator housing in the area of the winding are used for dissipating heat into the ambient air. In both cases the good heat conducting ability of the windings is used for cooling the bearing face.

In accordance with the preferred embodiment of the present invention, a pressure distribution device in the bearing face, particularly for larger rotor, is achieved in an advantageous and cost-effective manner in that the outlet bores are located in the cross-sectional area of the core of the stator, and that the gas distribution takes place, without interfering with the eveness of the magnetic flux, in an annular gap which is formed by concentric partial cores and is closed off on both sides by rings which are connected with each other, into which the outlet bores can be easily cut.

An advantageous embodiment for special operational conditions is achieved in that the gas bearing is designed as a dual-circuit system with outlet bores in the area of the interior diameter and the cross section of the stator core, wherein the two circuits can be operated together or respectively individually with the same or different gas pressure. This embodiment makes possible different combinations by means of which it is possible to meet the most varied demands in regard to operational states or operational dependability. If one circuit is disrupted, operational dependability is assured by the other.

In accordance with the preferred embodiment of the present invention, pressure sensors are provided which, in the single circuit gas system and the dual circuit system, are disposed in the gas distribution device and in the annular gap or in the gas supply line. Specific monitoring and controllability of the bearing gas pressure is possible in this way.

By means of the method for positioning the bearing center of the device it is possible in a very simple manner to compensate uneveness in size and magnetism of the holding and centering magnets, which lead to a displacement of the bearing center in accordance with which the axis of rotation of the spinning rotor is aligned. In the installed state of the device this axis of rotation is determined with the aid of a fitted spinning rotor rotating supercritically, and is positioned and fixed in a centered position in relation to the fitting elements of the device housing. This is suitably done by means of an adjusting device, with the aid of which the axis of rotation of the spinning rotor can be determined and brought into the centered position in relation to the fitting elements for the spinning machine.

In accordance with the preferred embodiment of the present invention, positioning is performed by displacing the lower housing part in relation to the upper housing part, which is inserted into the spinning machine.

The present invention further comprises recite different embodiments of the fitting elements in relation to which the stator is centered in accordance with the process.

The reduction of the many individual parts of the device also decreases its structural space requirements.

Some exemplary embodiments of the invention are represented in the drawings and are described in detail below.

DETAILED DESCRIPTION OF THE PREFERRED EMBODIMENT

Figure 1:
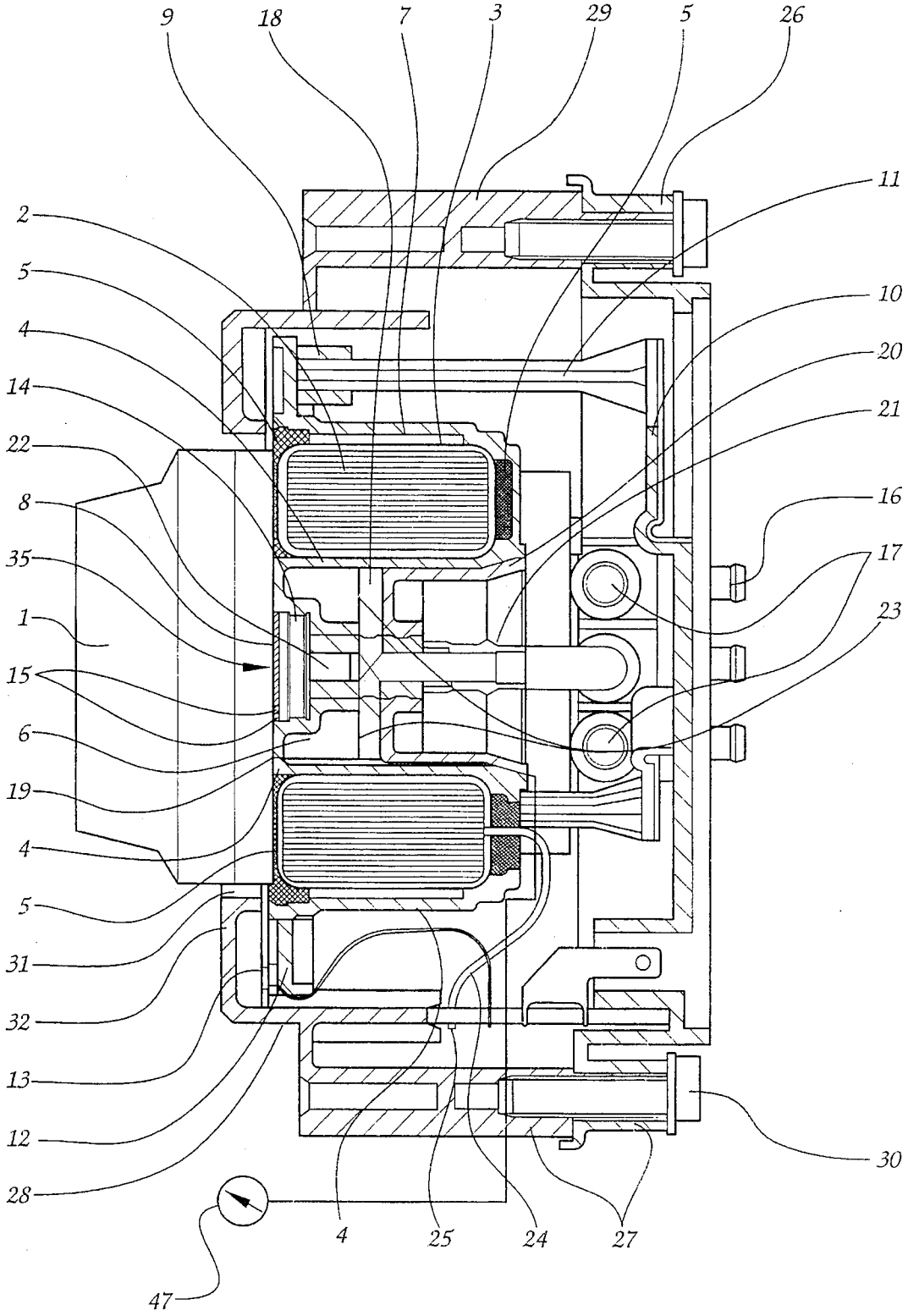
FIG. 1, a longitudinal section through the device with a single circuit gas system.

FIG. 1 shows a longitudinal section through the device with fitted spinning rotor 1, which has been positioned in a spinning machine, not shown, in such a way that the axes of rotation and of the draw-off nozzle are aligned. A core 2 of the stator with a multi-phase winding 3 has been securely and sealingly cast with a sealing compound 5 into a one-piece stator housing 4.

The following elements are combined into one part in or are formed on a stator housing 4:

A gas bearing housing with a gas distribution device 6, a cooling conduit 7 for cooling the stator and a bearing face 8, a holder 9 for the spring and damping elements 10, 11, a support 12 for a sensor plate 13. A yoke plate 14 for the holding and centering magnets 15 and connections 16 for supply lines 17 are integrated into the stator housing 4. On the side of the stator facing the rotor, the sealing compound 5, together with the wall of the stator housing 4 and the holding and centering magnets 15, forms the plane-parallel bearing face 8. In it terminate outlet bores 19, coming from a gas chamber 18 and located closely at its edge.

The open side of the gas chamber 18 in the stator housing 4 is sealed by a gas bearing cover 20, having an injection-molded connector 21 containing a threaded bore. The gas bearing cover 20 is screwed together with a threaded stem 22 of the yoke plate 14 which was injection-molded in the stator housing 4. The gas chamber 18 of the stator housing 4 is reinforced by ribs 23 located in the interior. The sensor plate 13, embodied as a flexible printed circuit foil, rests on the support 12 of the stator housing 4 and is fixed in place by the sealing compound 5. The winding connections 24 are passed out through segment-shaped openings in the stator housing 4 and are connected, together with the sensor plate 13, at a contact point 25.

The elastic suspension of the stator consists of the spring and damping elements 10 and 11, which are embodied as plate springs 10, injection-molded on a lower housing part 26 of a device housing 27, and on the free ends of which bar springs 11 have been formed. The bar springs 11 are locked into the holders 9 of the stator housing 4.

The centering collar of the device housing 27 is used as the fitting element 28 for the installation of the device into the spinning machine. The bearing center, defined by the holding and centering magnets 15, is positioned in relation to it in that it is determined with the aid of the spinning rotor supercritically rotating in the installation position of the device, is brought into a centered position by radially displacing the lower housing part 26 in relation to the upper housing part 29 and is fixed there by connecting screws 30 of the device housing 27.

The device operates as follows: an equilibrium is formed between the gas pressure and the magnetic force of the holding and centering magnets 15, so that the spinning rotor can rotate contactless around the axis through its center of gravity. So that the spinning rotor 1 can pass without problems through critical rpm, the oscillations occurring in the course of this and transmitted via a rigid magnetic guidance to the stator are damped by its elastic suspension in the device housing 27. The spinning rotor 1 is enclosed by a guide ring 32 of the device housing 27 which forms an annular gap 31 and limits the rotor deflection, for example at the critical rpm.

Figure 2:
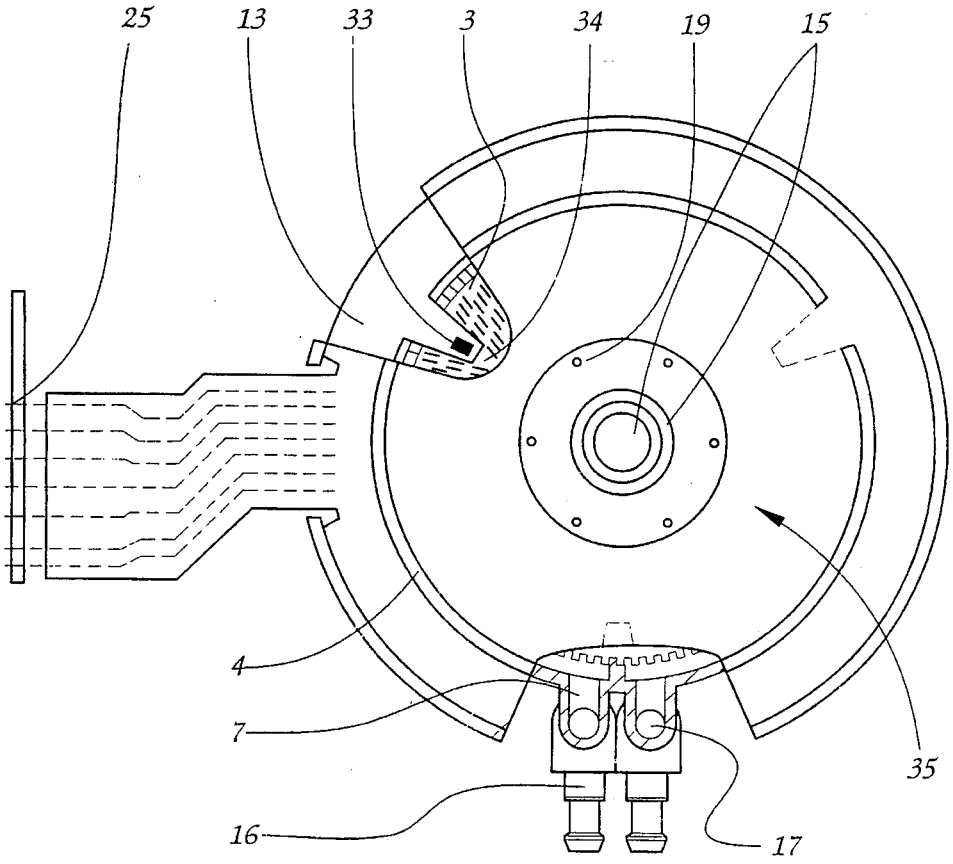
FIG. 2, a top view on the stator without the device housing and with two partial cutouts in the stator housing.

FIG. 2 shows the stator in a top view with two partial cutouts in its stator housing 4. The connections 16 of the supply for the cooling conduit 7 and integrated into the stator housing have been made visible in one cutout. The other cutout shows the winding 3 located under the sealing compound 5 and the sensor plate 13 with a sensor 33 in the winding gap 34. The combined magnetic-gear bearing 35 is shown in the center as rings; a circle of gas outlet bores 19 is visible in the stator housing around the ring-shaped holding and centering magnets 15. The sensor plate 13 is brought to the contact point 25 through a segment-shaped opening in the stator housing 4.

Figure 3:
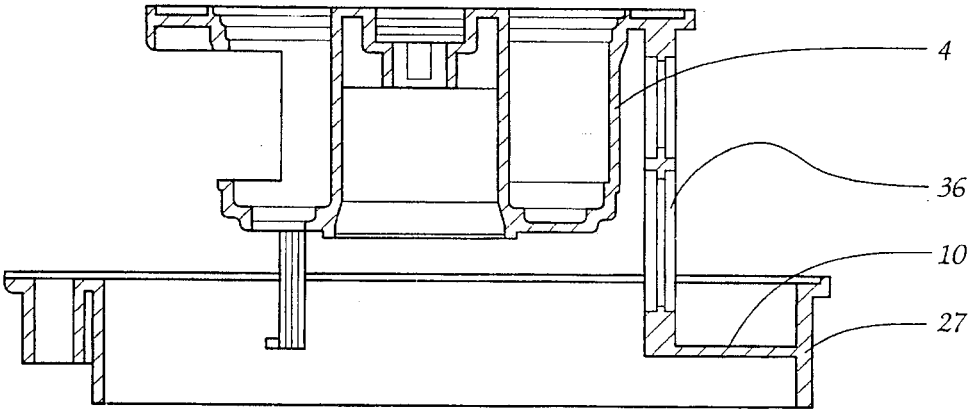
FIG. 3, a longitudinal section through the stator housing and the lower housing part in an embodiment having a one-piece common housing.

FIG. 3 shows an embodiment with a one-piece stator and device housing in longitudinal section. The stator housing 4 and the lower housing part 26 are one common part, wherein connections 36 as spring and damping elements are placed between the two. Positioning of this one-piece housing takes place with the same means of the described exemplary embodiment.

Figure 4:
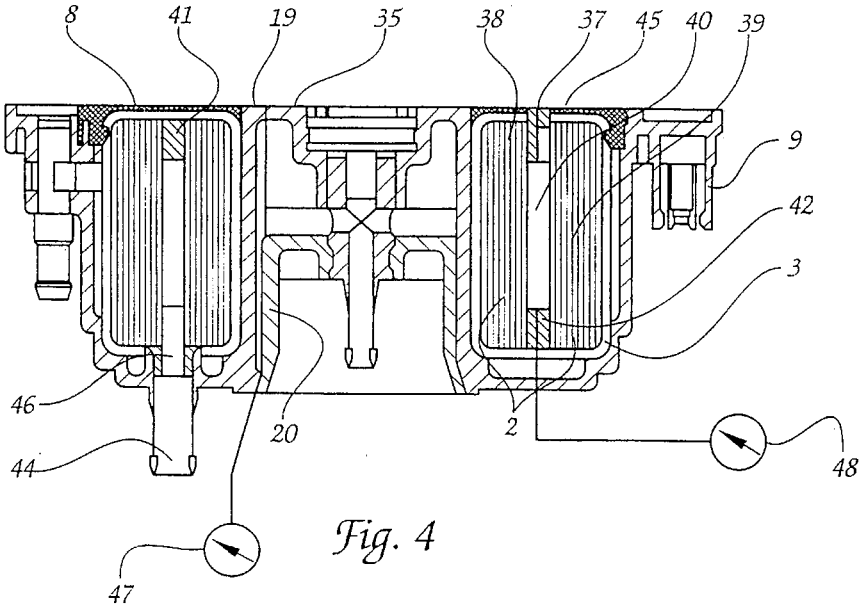
FIG. 4, a longitudinal section through the stator with a dual-circuit system.

FIG. 4 shows the exemplary embodiment of a stator with a gas bearing 35 as a dual-circuit system, wherein the outlet bores 19 of the one circuit are located in the area of the interior diameter of the core 2 and the outlet bores 37 of the second circuit are located in the cross-sectional area of the core 2. Depending on the operational requirements, the two circuits can be connected individually or together and with the same or different gas pressure. The core 2 consists of two concentric partial cores 38, 39, which form an annular gap 40 for gas distribution and which is sealingly closed at both ends by rings 41, 42. These are shown in greater detail in FIGS. 5 and 6.

Figure 5:
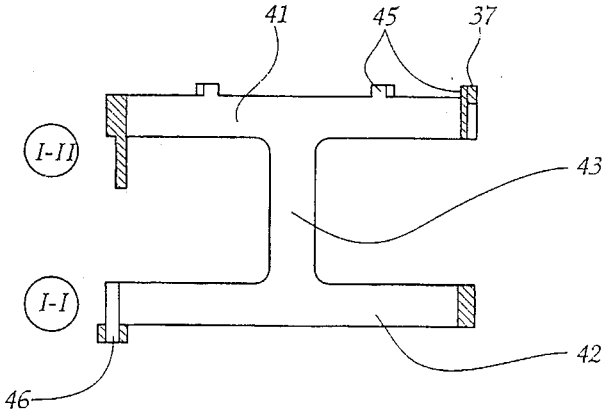
FIG. 5, a longitudinal section through the two rings of the embodiment of FIG. 4.

FIG. 5 shows the two rings 41, 42 in longitudinal section. The upper ring 41 is connected with the lower ring 42 by bars 43, the thickness of which is less than the width of the annular gap 40. The upper ring 41 has axial projections 45 for the outlet bores 37. Following assembly, the axial projections 45 are located in winding gaps 34 of the stator and are of the length of the cast winding 3. The lower ring 42 has a gas inlet opening 46 which can be connected with a connector 44.

Figure 6:
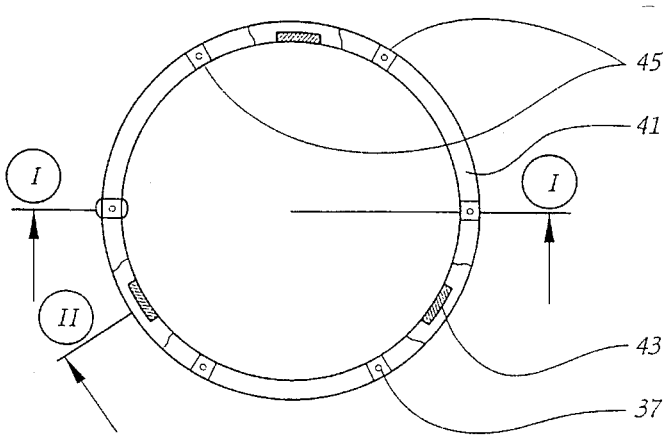
FIG. 6, a top view on the upper ring of the embodiment of FIG. 4.

FIG. 6 shows a top view of the upper ring 41, the bars 43 can be seen in three cutouts. The axial projections 45 which, after installation of the stator, terminate in the bearing face 8 are shown with the outlet bores 37 on the upper ring 41.

The exemplary embodiment in accordance with FIG. 4 can be simplified for spinning rotors with larger diameters by doing away with the inner gas bearing circuit. Because of this, the inner outlet bores 19 and the gas bearing cover 20 with the connector can be omitted. If the outlet bores 37 are located in the cross-sectional area of the stator, a gas pressure distribution is obtained which is adapted to the larger rotor diameter.

We claim:

1. A device for an open end spinning machine with a drive and bearing for a shaftless spinning rotor forming the rotor of an axial field motor, wherein the device comprises the stator with a grooveless hollow-cylindrical core and a multiphase winding and with sensors for detecting the spinning rotor position in gaps of the winding and a combined magnetic-gas bearing with gas outlet bores in an axial, plane-parallel bearing face, axis-symmetrical gas distribution and holding and centering magnets disposed centered in the bearing face and means for cooling the stator and the magnetic-gas bearing as well as an elastic, damped stator suspension on a device housing, characterized in that the housings of the stator and the gas bearing are combined into a one-piece stator housing (4), in which are formed the means for cooling (7), the gas distribution device (6), holders (9) for the spring and damping elements (10, 11) of the suspension of the stator housing (4), and a support (12) for the sensor plate (13), and in which a yoke plate (14) of the magnetic bearing (35) and connections (16) for supply lines (17) are integrated and wherein a gas chamber (18) is sealing closed off on the open side by a gas bearing cover (20) and is reinforced in the interior by ribs (23), and the device housing (27) has fitting elements (28) adapted to the spinning machine and the spinning rotor (1) is surrounded by a guide ring (32) which forms an annular gap (31) and limits its deflection out of the bearing center.

2. A device in accordance with claim 1, characterized in that the yoke plate (14), having a threaded stem (22), is injection-molded on the stator housing (4), and a gas connector (21) with a threaded bore on the gas bearing cover (20), and the stator housing (4) and the gas bearing cover (20) are sealingly screwed together.

3. A device in accordance with claim 1, characterized in that the device housing (27) consists of an upper housing part (29) and a lower housing part (26) with connecting spring and damping elements (10,11), wherein these elements (10, 11) are formed out together with the lower housing part (26).

4. A device in accordance with claim 3, characterized in that the spring and damping elements (10, 11) are embodied as plate springs (10) on the lower housing part (26) and as bar springs (11) seated between the holders (9) on the stator housing (4) and the plate springs (10).

5. A device in accordance with claim 3, characterized in that the stator housing (4) and the lower housing part (26) are made of one piece, wherein connections (36) between them are embodied as spring and damping elements.

6. A device in accordance with claim 1, characterized in that an annular gap (31) between the guide ring (32) and the inserted spinning rotor (1) is narrower than its distance from the spinning machine.

7. A device in accordance with claim 1, characterized in that the sensor plate (13) is embodied as a flexible printed circuit foil, on which Hall sensors (33) for motor control and temperature sensors are positioned close to the magnetic-gas bearing (35) and are connected, and the stator housing (4) has segment-shaped openings through which winding contacts are passed to a contact point (25).

8. A device in accordance with claim 1, characterized in that the area of the winding (3) a cooling conduit (7), through which a coolant flows, has been embodied for means for cooling the stator and the gas bearing.

9. A device in accordance with claim 1, characterized in that the area of the windings (3) the stator housing (4) has openings which are provided for a directed heat dissipation to the ambient air.

10. A device in accordance with claim 1, characterized in that outlet bores (37) are located in the cross-sectional area of the core (2) of the stator, and that it consists of two concentric partial cores (38, 39) which form an annular gap (4) for gas distribution, which is closed off on both sides by rings (41, 42) which are connected with each other by bars (43), the thickness of which is less than the annular gap width, that the upper ring (41) has axial projections (45) for the outlet bores (37), which are located in the winding gaps and have the height of the cast winding, and that in the area of the outlet bores (37) the upper ring (41) has cutouts for shortening the bore length, and that the lower ring (42) has a gas inlet opening (46) which is connected with a connector (44).

11. A device in accordance with claim 1 or 10, characterized in that the gas bearing (35) is embodied as a dual-circuit system, wherein outlet bores (19) of the one circuit are located in the area of the interior diameter of the core (2) and outlet bores (37) of the second are located in the area of a cross section, and that the two circuits can be connected individually or together, with the same or different gas pressures, depending on the operational requirements.

12. A device in accordance with claim 10, characterized in that pressure sensors are provided in the single circuit or dual-circuit systems in the gas supply lines or in the gas distribution device (6) and in the annular gap (40) for monitoring the gas pressure for the gas bearing (35).

13. A device in accordance with claim 1, characterized in that the device housing (27) consists of an upper housing part (29) and a lower housing part (26), which for centering can be displaced in relation to each other and fixed in place, wherein the lower housing part (26) contains the connecting elements to the stator and the upper housing element (29) the fitting elements (28) to the spinning machine.

14. A device in accordance with claim 13, characterized in that the fitting elements (28) of the device housing (27), which are adapted to the spinning machine, are selectively embodied as a centering collar on the upper housing part (29) or as pin bores or pegs.

15. A device in accordance with claim 13, characterized in that when the device housing (27) has been fitted free of play, cuttingly processed fitting surfaces, which are positioned in respect to the bearing center, are disposed on its upper housing part (29).

16. A device for an open-end spinning machine having a drive and a bearing for a shaftless spinning rotor (1) representing the rotor of an axial field motor, wherein the device comprises a stator having a hollow-cylindrical core (2) and a winding (3) and a combined magnetic/gas bearing with gas outlet openings (37) in an axial bearing face (8) arranged for axis-symmetrical gas distribution, wherein the core (2) of the stator comprises two concentric partial cores (38,39) forming an annular gap (40) for the gas distribution and the gas outlet openings (37) are located in the cross-sectional area of the core (2) of the stator at the gap (40).

17. A device in accordance with claim 16, wherein the annular gap (40) is closed at opposite sides by rings (41,42) which are connected with one another by bars (43) having a thickness less than the annular width of the gap (40).

18. A device in accordance with claim 17, wherein one ring (41) has axial projections (45) for the gas outlet openings (37), the gas outlet openings (37) being located in gaps in the winding (3).

19. A device in accordance with claim 18, wherein the one ring (41) has recesses for shortening the bore length in the area of the gas outlet openings (37).

20. A device in accordance with claim 17, wherein one ring (42) has a gas inlet opening (46) communicated with a connector element (44).

21. A device in accordance with claim 16, wherein the gas bearing (35) comprises a dual-circuit system having outlet bores (19) located in the area of the interior diameter of the core (2), the two circuits being connectable individually or together, at the same or different gas pressures, depending on the operational requirements for the device.

22. A device in accordance with claim 21, wherein pressure sensors are provided in the single circuit dual-circuit systems in gas supply lines or in a gas distribution device (6) and in the annular gap (40) for monitoring the gas pressure for the gas bearing (35).

* * * * *